US007845831B2

(12) United States Patent
Byrne

(10) Patent No.: US 7,845,831 B2
(45) Date of Patent: Dec. 7, 2010

(54) LIGHT WITH HEATER

(75) Inventor: Brendan Patrick Byrne, Germantown, TN (US)

(73) Assignee: Hunter Fan Company, Memphis, TN (US)

( * ) Notice: Subject to any disclaimer, the term of this patent is extended or adjusted under 35 U.S.C. 154(b) by 255 days.

(21) Appl. No.: 12/107,103

(22) Filed: Apr. 22, 2008

(65) Prior Publication Data

US 2008/0266867 A1 Oct. 30, 2008

Related U.S. Application Data

(60) Provisional application No. 60/914,164, filed on Apr. 26, 2007.

(51) Int. Cl.
*F21V 29/00* (2006.01)

(52) U.S. Cl. ..... 362/294; 362/96; 362/145; 362/147; 362/150

(58) Field of Classification Search ..... 362/96, 362/294, 145, 147–450
See application file for complete search history.

(56) References Cited

U.S. PATENT DOCUMENTS

| | | | | | |
|---|---|---|---|---|---|
| 2,010,322 | A | * | 8/1935 | Riddell | 454/293 |
| 2,189,008 | A | * | 2/1940 | Kurth | 454/242 |
| 2,689,906 | A | * | 9/1954 | Corbett | 392/347 |
| 3,025,379 | A | | 3/1962 | Ford | |
| 3,068,341 | A | * | 12/1962 | Ortiz et al. | 219/220 |
| 3,141,086 | A | | 7/1964 | Prager | |
| 3,786,233 | A | | 1/1974 | Bumpus et al. | 219/343 |
| 3,958,100 | A | | 5/1976 | Stone | 219/361 |
| 4,681,024 | A | * | 7/1987 | Ivey | 454/233 |
| 5,021,932 | A | | 6/1991 | Ivey | 362/96 |
| 5,077,825 | A | | 12/1991 | Monrose | 392/361 |
| 5,333,235 | A | | 7/1994 | Ryder | 392/364 |
| 5,425,126 | A | | 6/1995 | Lee | 392/364 |
| 5,513,296 | A | * | 4/1996 | Goldstein | 392/365 |
| D381,074 | S | | 7/1997 | Pelonis | D23/336 |
| 5,664,872 | A | * | 9/1997 | Spearman et al. | 362/96 |
| 5,668,920 | A | | 9/1997 | Pelonis | 392/361 |
| D404,123 | S | | 1/1999 | Pelonis | D23/336 |
| 6,095,671 | A | * | 8/2000 | Hutain | 362/373 |
| D435,094 | S | | 12/2000 | Bucher | D23/336 |
| 6,240,247 | B1 | | 5/2001 | Reiker | 392/364 |
| 6,438,322 | B1 | | 8/2002 | Reiker | 392/364 |
| 6,477,321 | B2 | | 11/2002 | Reiker | 392/364 |
| 6,631,243 | B2 | | 10/2003 | Reiker | 392/364 |
| 6,751,406 | B2 | | 6/2004 | Reiker | 392/364 |
| 7,500,760 | B2 | * | 3/2009 | Byrne | 362/92 |
| 2005/0105302 | A1 | | 5/2005 | Hofmann et al. | 362/555 |

* cited by examiner

*Primary Examiner*—Sandra L O Shea
*Assistant Examiner*—Danielle Allen
(74) *Attorney, Agent, or Firm*—Baker Donelson

(57) ABSTRACT

A light fixture (10) is provided having a wall housing (11) and lighting arms (12). The light fixture includes a heating source (17) mounted within the wall housing. The wall housing includes an external wall (19) adapted to be mounted to a vertical wall of a structure. The external wall has a top (19*a*), bottom (19*b*), two oppositely disposed sides (19*c*), and a front face (19*d*). The housing top has an air intake opening (20). The housing bottom has an air exhaust outlet (21) which directs air in a downwardly direction. The wall housing also includes an air channel (23) which commences at air intake opening and ends at air exhaust outlet. The heat source includes a heating element (25) mounted within the airflow channel and a motorized fan (26) to create an air flow through the channel which exits through the air exhaust outlet.

8 Claims, 2 Drawing Sheets

LIGHT WITH HEATER

REFERENCE TO RELATED APPLICATION

Applicant claims the benefit of priority to U.S. Provisional Patent Application Ser. No. 60/914,164, entitled "LIGHT WITH HEATER," and filed on Apr. 26, 2007, which is incorporated by reference herein.

TECHNICAL FIELD

This invention relates generally to light fixtures, and more particularly to light fixtures having heating capabilities.

BACKGROUND OF THE INVENTION

Lighting fixtures have existed for many years. Recently, some lighting fixtures have incorporated heaters to warm the surrounding air. These light fixtures are typically placed in a bathroom so as to heat the room in order to make it more comfortable for people after taking a shower or bath. As such, these light fixtures are not designed to blend into the more formal aesthetics of other rooms within a typical home.

Accordingly, it is seen that a need remains for a light fixture that can provide heat but which is unobtrusive and easy to maintain. It is to the provision of such therefore that the present invention is primarily directed.

SUMMARY OF THE INVENTION

In a preferred form of the invention, a light fixture comprises a housing adapted to be mounted to a vertical structure, the housing have an upwardly facing top, a downwardly facing bottom, a front and two oppositely disposed sides, an air inlet extending through the housing, and an air exhaust opening extending through the bottom of the housing. The housing also including an air channel extending between the air intake opening and air exhaust opening. The light fixture also includes a light source coupled to the housing, a heat source mounted within the channel to heat air passing through the housing air channel, and a fan mounted within the channel to create an airflow through the channel. With this construction, an airstream passing through the housing is heated by the heat source and expelled from the exhaust opening in a downwardly direction.

DETAILED DESCRIPTION

Figure 1:
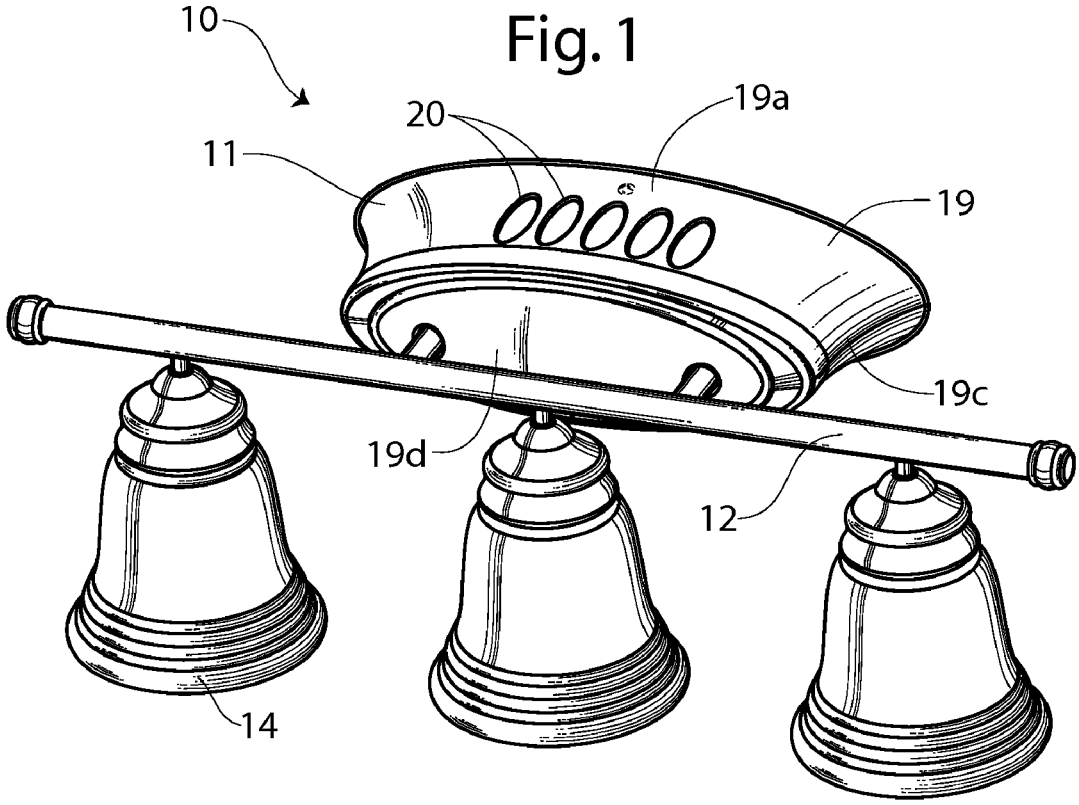
FIG. 1 is a perspective view of a light fixture of the present invention.
Figure 2:
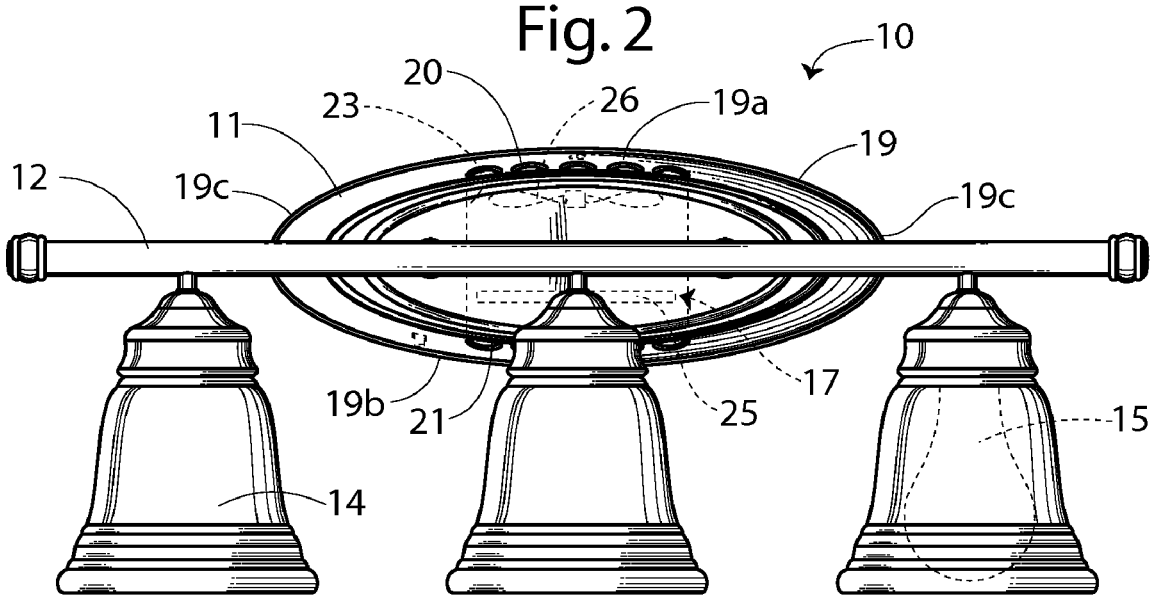
FIG. 2 is a front view of the light fixture of FIG. 1.
Figure 3:
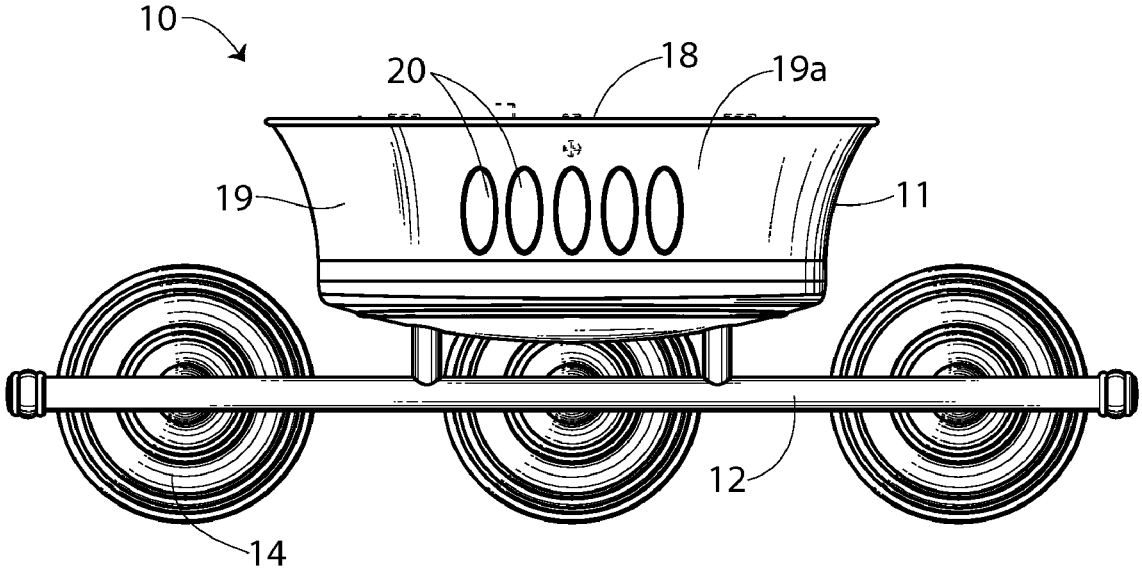
FIG. 3 is top view of the light fixture of FIG. 1.
Figure 4:
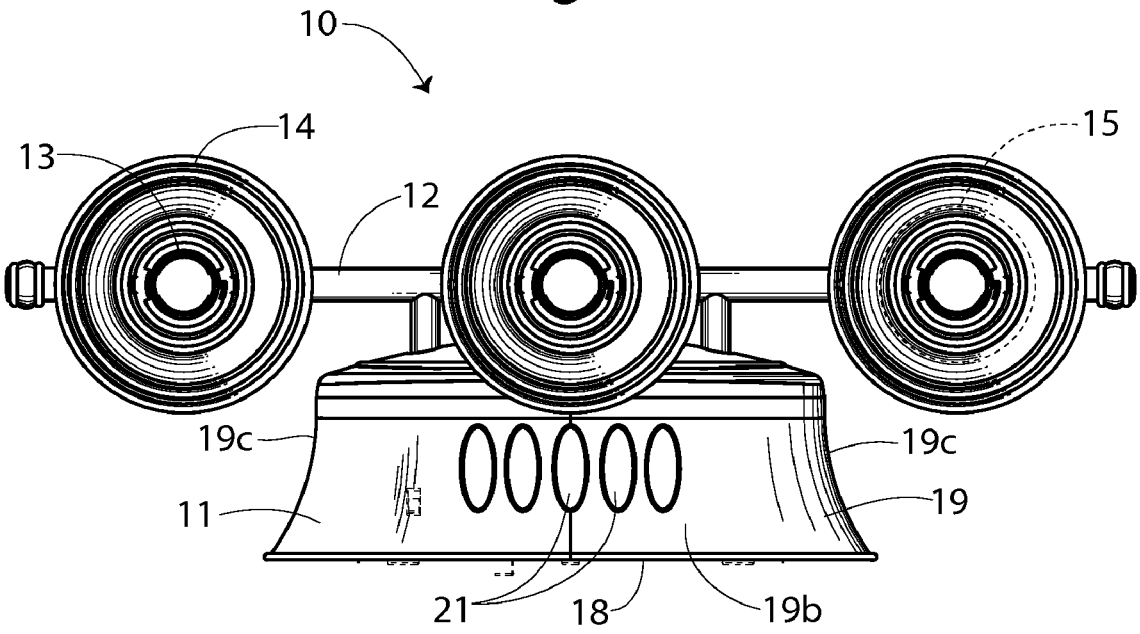
FIG. 4 is a bottom view of the light fixture of FIG. 1.

With reference next to the drawings, there is shown a light fixture 10 in a preferred form of the invention. The light fixture 10 is shown in the form of a wall sconce. The light fixture 10 includes a wall housing 11, a lighting arm 12 terminating with light sockets 13, a translucent shade or light diffuser 14, and a light bulb 15 mounted to the light socket. The light fixture also includes a heating source 17 mounted within the wall housing 11. The light socket 13 is electrically coupled to electric wires which are coupleable to the electric wires within a home in conventional fashion.

The wall housing 11 includes a wall mounting plate 18 and an external wall 19 adapted to be mounted to a vertical wall or junction box of a structure in conventional fashion through the wall mounting plate 18. The external wall 19 has a top 19*a*, bottom 19*b*, two oppositely disposed sides 19*c*, and a front face 19*d*. The housing top 19*a* has an air intake opening 20. The housing bottom 19*b* has an air exhaust outlet 21 which directs air in a downwardly direction. The wall housing 11 also includes an air channel 23 extending therethrough which commences at air intake opening 20 and ends at air exhaust outlet 21.

The heat source 17 includes a heating element 25 mounted within the airflow channel 23. The heating elements 25 may be positive temperature coefficient heaters (PTC heaters). The heat source 17 also includes a motorized fan 26 within the air channel 23 to create an air flow which enters the light fixture 10 through the air intake opening 20, flows through the air channel 23, through the fan 26, through the heating element 25, and exits through the air exhaust outlet 21. The heating elements 25 and motorized fan 26 are coupled to the home wiring in conventional fashion.

In use, the light fixture may be used as a light, as a heater, or as both a light and a heater. The light source and/or heat source may be supplied with an electric current through the electrical wires through any conventional switch or switches, such as wall switches, switches mounted to the device itself such as a pull cord switch, or remote controlled switches such as an RF control circuit. The use of two switches allows an operator to turn the heater and fan on or off without effecting the operation or illumination of the light and visa-versa. During use as a heater or as a combination light and heater, the fan 26 creates an airstream that is heated by the heating element 25 and is passed through air channel 23 and expelled from the housing 11 through the air exhaust outlet 21.

It should be understood that the present invention enables the light fixture to be mounted to a wall rather than a ceiling. The position of the light fixture upon a wall allows it to be mounted at a position much lower than the ceiling. This in turn, creates a heated airstream which is generated much closer to a person within the room, thereby reducing the quantity of heat required to warm a person and generating the heat at a lower position to heat the entire room more efficiently as the heat subsequently rises within the room. The heat is also more concentrated as the adjacent wall limits dispersion of the heat in that direction. It should also be noted that the air exhaust opening is horizontally aligned with at least a portion of the light source, here the middle light diffuser. As such, the light source obscures the view of the air exhaust opening.

It should be understood that the positioning of the air intake opening 20 and air exhaust outlet may be positioned anywhere upon the housing. For instance, the air intake opening and the air exhaust outlet may be positioned upon the sides of the housing. However, it should be understood that the preferred orientation of the air exhaust opening is on the bottom or bottom wall as this provides a heated airstream directed towards a person positioned below the light, as this is the likely position of a person situated at a vanity above which a light mounted to a vertical structure would likely exists. This also provides a downward heated airstream which will eventually rise due to the physics of heated air. As such, this provides for a more even distribution of the heated air throughout the room.

It thus is seen that a light fixture is now provided which provides heat but which is unobtrusive. While this invention has been described in detail with particular reference to the preferred embodiment thereof, it should be understood that many modification, additions and deletions, may be made thereto without departure from the spirit and scope of the invention as set forth in the following claims.

The invention claimed is:

1. A light fixture comprising, a housing adapted to be mounted to a vertical structure, said housing having an upwardly facing top wall, a downwardly facing bottom wall oppositely disposed from said top wall, a front wall and two oppositely disposed side walls, an upwardly facing air inlet extending through said housing top wall, and a downwardly facing air exhaust opening extending through said bottom wall of said housing oppositely disposed from said upwardly facing air inlet, said housing also including an air channel extending between said air intake opening and said air exhaust opening;

a light source coupled to said housing;

a heat source mounted within said channel to heat air passing through said housing air channel, and a fan mounted within said channel to create an airflow through said channel, whereby an airstream passing through the housing is heated by the heat source and expelled from the exhaust opening in a downwardly direction.

2. The light fixture of claim 1 wherein said air intake opening is positioned upon said housing top wall.

3. The light fixture of claim 1 wherein said heat source is a positive temperature coefficient heater.

4. The light fixture of claim 1 wherein said air exhaust opening is horizontally alighted with at least a portion of said light source, whereby the light source obscures the view of the air exhaust opening.

5. A light fixture comprising, a housing adapted to be mounted to a vertical structure, said housing having an upwardly facing top wall, a downwardly facing bottom wall opposite said top wall, a front wall and two oppositely disposed side walls, an air inlet extending through said housing top wall, and an air exhaust opening extending through said housing bottom wall oppositely from said air intake opening and in a manner to direct an airflow passing through said air exhaust opening in a downwardly direction, said housing also including an air channel extending between said air intake opening and said air exhaust opening;

a light source coupled to said housing;

a heat source mounted within said channel to heat air passing through said housing air channel, and a fan mounted within said channel to create an airflow through said channel, whereby an airstream passing through the housing is heated by the heat source and expelled from the exhaust opening in a downwardly direction.

6. The light fixture of claim 5 wherein said air intake opening is positioned upon said housing top wall.

7. The light fixture of claim 5 wherein said heat source is a positive temperature coefficient heater.

8. The light fixture of claim 5 wherein said air exhaust opening is horizontally aligned with at least a portion of said light source, whereby the light source obscures the view of the air exhaust opening.

* * * * *